US005957059A

United States Patent [19]

Burhman

[11] Patent Number: 5,957,059

[45] Date of Patent: Sep. 28, 1999

[54] COMPUTER DESK

[76] Inventor: Gary Burhman, 27 E. Sherwood Dr., Overland, Mo. 63119

[21] Appl. No.: 09/144,657

[22] Filed: Sep. 1, 1998

[51] Int. Cl.[6] ..... A47B 85/00

[52] U.S. Cl. ..... 108/13; 108/50.01; 108/147.18; 312/223.3; 312/194

[58] Field of Search ..... 108/11, 13, 17, 108/23, 50.01, 50.02, 147.18, 147.19, 147.21, 144.11; 312/223.2, 223.3, 194, 324, 327, 328, 7.2, 8.15, 21, 208.1; 248/918

[56] References Cited

U.S. PATENT DOCUMENTS

| | | | |
|---|---|---|---|
| 2,452,160 | 10/1948 | Smith | 108/147.21 X |
| 2,696,246 | 12/1954 | Putnam | 108/144.11 X |
| 4,145,097 | 3/1979 | Naess et al. | 248/918 X |
| 4,590,866 | 5/1986 | Schairbaum | 108/23 |
| 4,695,104 | 9/1987 | Lederman | 312/223.3 |
| 4,766,422 | 8/1988 | Wolters et al. | 312/223.3 X |
| 4,828,342 | 5/1989 | Stefan | 312/223.3 |
| 5,094,514 | 3/1992 | Grosch | 312/223.3 X |
| 5,242,217 | 9/1993 | Gonnet | 312/194 |
| 5,368,377 | 11/1994 | Baines | 312/194 X |
| 5,544,594 | 8/1996 | Schairbaum | 108/50.01 |
| 5,655,822 | 8/1997 | Roberts et al. | 108/50.01 X |
| 5,699,225 | 12/1997 | Yavitz et al. | 312/223.3 X |

*Primary Examiner*—Peter M. Cuomo
*Assistant Examiner*—Hanh V. Tran
*Attorney, Agent, or Firm*—Polster, Lieder, Woodruff, & Lucchesi

[57] ABSTRACT

A computer desk is provided to house a computer system comprising a computer, a monitor, and a keyboard. The computer desk includes a first leg, a second leg, and a desk top extending between the first and second legs. A monitor shelf is positioned below the desktop, and a computer box sized and shaped to accept the computer is positioned against an outer surface of one of the legs. The desk top extends across the top of the legs and computer box. The portion of the desktop above the computer box is fixed. However, the portion of the desktop between the desk's legs is convertible between a closed position in which the desktop can be used as a writing surface and an opened position in which the monitor and keyboard are exposed and accessible to facilitate use of the computer system.

18 Claims, 8 Drawing Sheets

COMPUTER DESK

CROSS-REFERENCE TO RELATED APPLICATIONS

Not Applicable

STATEMENT REGARDING FEDERALLY SPONSORED RESEARCH OR DEVELOPMENT

Not Applicable.

BACKGROUND OF THE INVENTION

This invention relates generally to computer desks, and in particular, to computer desks for use in schools. Although the invention is described for use in schools, it will be appreciated that the computer desk of the present invention can be used in other environments, such as a home.

Schools are using computers more and more frequently as part of their education curriculum. Typically, schools have computer labs or computer rooms which are dedicated solely to computer use. Such computer rooms often have one or more long tables on which two or more computers are placed. The room may also include a printer and other peripheral equipment. Although such rooms are well suited for their use in education, the rooms must be reserved by individual classes so that only one class will use the room at a time. Relying on room availability creates unneeded burdens for teachers in planning their classes. Further, the dedication of the room for use as a computer room prevents the room from being used as a general classroom or for other purposes.

It would be preferable if students were provided with computers at their desks. This would overcome the problems associated with dedicated computer rooms. There are numerous styles of computer desks currently available. However, none of the computer desks can function both as a flat desk upon which a student can write and as a computer desk. Further they are not well suited for use in schools. The desks currently available generally have at least the computer monitor sitting on the desk surface. Obviously, such placement of the monitor will prevent the desk from being used for any other purpose. Office desks have been made in which the monitor is placed below the desk top, and a glass window is placed above the monitor, so that the monitor will be visible to the user. Such desks overcome the problem with the monitor on the desk top. However, they create other problems for school use. Such desks generally have a keyboard drawer which pulls out. To use the keyboard, and hence the computer, the user of the computer must back up. However, in a classroom in which the desks are arranged in rows, the student may not be able to back up a distance sufficient to enable him to use the keyboard.

BRIEF SUMMARY OF THE INVENTION

A computer desk is provided to house a computer system including a computer, a monitor, and a keyboard. The computer desk includes a first leg, a second leg, and a desk top extending between the first and second legs. A monitor shelf is positioned below the desktop, and a computer box sized and shaped to accept the computer is positioned against an outer surface of one of the legs. The desk top extends across the top of the legs and computer box. The portion of the desktop above the computer box is fixed. However, the portion of the desktop between the desk's legs is convertible between a closed position in which the desktop can be used as a writing surface and an opened position in which the monitor and keyboard are exposed and accessible to facilitate use of the computer system.

The convertible portion of the desktop includes a pivotal rear portion which defines a monitor cover and a pivotal forward portion which defines a keyboard tray. The monitor cover is divided into two parts. A first part is hinged forwardly of its back edge to a back panel of the desk. The second part is hinged, at its back end, to the front end of the first part. Thus, the monitor cover, when opened, can be moved between a folded position and an unfolded position.

The keyboard tray is pivotable or rotatable about an axis which is approximately midway between the forward and rear edges of the keyboard tray. Thus, the forward edge of the keyboard tray (in both the opened and closed position) is in approximately the same position relative to the forward edge of the legs. The user of the desk thus need not move rearwardly to open the keyboard. Preferably, a lock is provided to keep the keyboard tray in the closed position. The keyboard is held to the keyboard by brackets which prevent the keyboard from falling off the keyboard tray when the desk top is closed.

The monitor is held to the monitor shelf by a pair of brackets which interact with the monitor's base to hold the monitor in position. Preferably, the height of the monitor shelf and the position of the monitor brackets can be adjusted to compensate for the use of larger or smaller monitors.

Additionally, the height of the desktop is preferably alterable. The legs of the computer desk each include an upper part and a lower part which are connected together with bolts or the like. The length of the legs can thus be changed to raise or lower the desktop.

BRIEF DESCRIPTION OF THE SEVERAL VIEWS OF THE DRAWINGS

Corresponding reference numerals will be used throughout the several figures of the drawings.

DETAILED DESCRIPTION OF THE INVENTION

Figure 1:
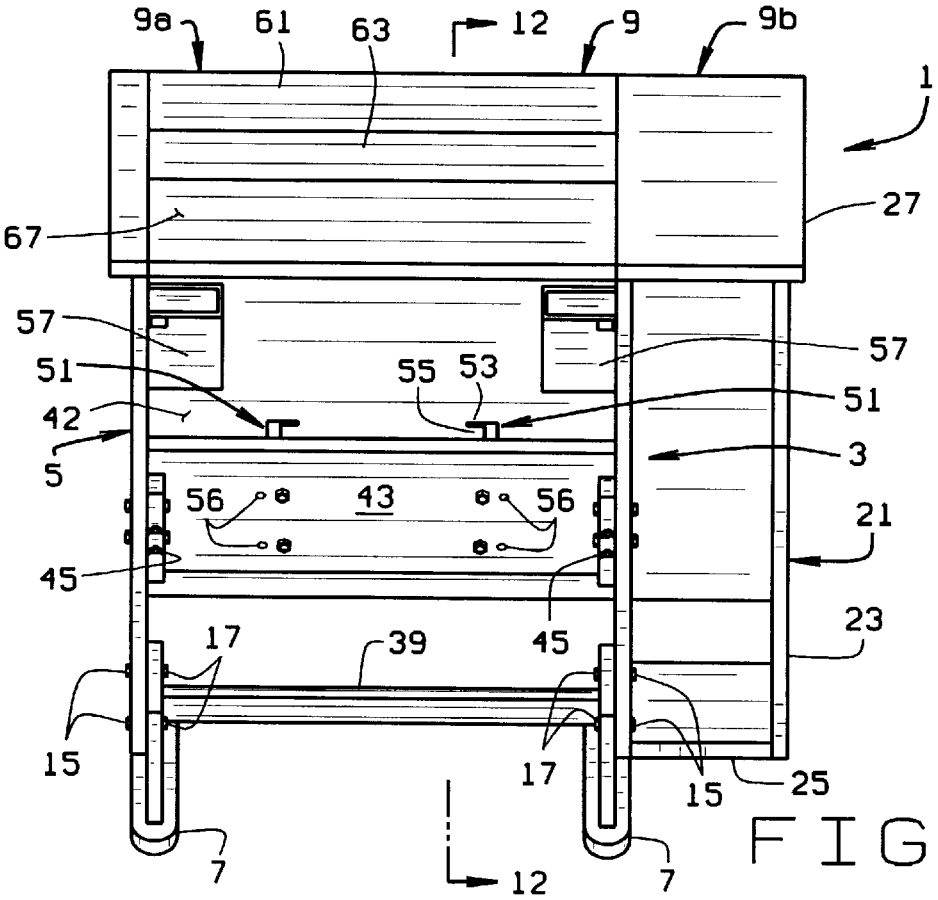
FIG. 1 is a top perspective view of a computer desk of the present invention, the desk being closed for use as a writing surface.
Figure 2:
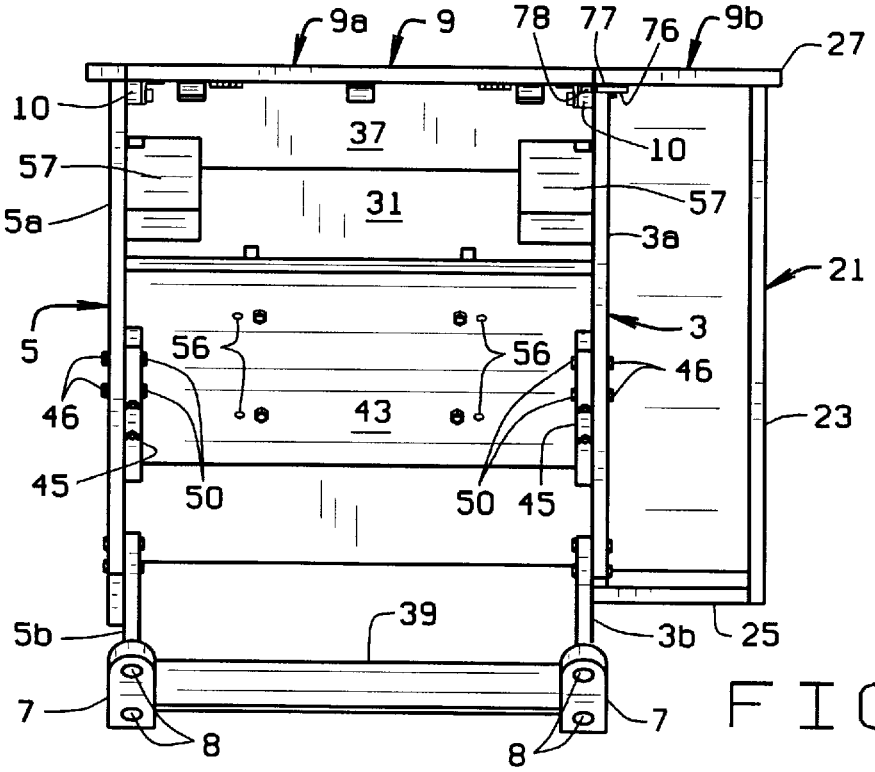
FIG. 2 is a perspective view of the computer desk with the desk tilted back so that the desk top is level.
Figure 3:
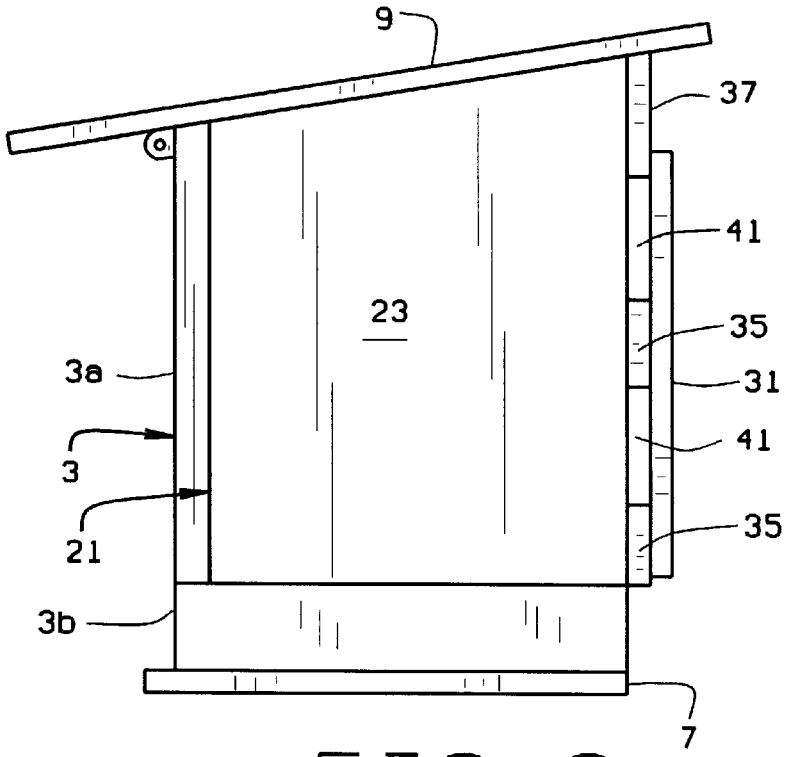
FIG. 3 is a right side elevational view of the computer desk.

The following detailed description illustrates the invention by way of example and not by way of limitation. This description will clearly enable one skilled in the art to make and use the invention, and describes what I presently believe is the best mode of carrying out the invention.

A computer desk 1 of the present invention houses a computer system including a computer C, monitor M, keyboard K, and typically a mouse (not shown). The computer desk 1 is shown in FIGS. 1–5 in a closed position, so that the desk may be used as a writing desk, or as a surface upon which books, papers, etc. may be spread for use in traditional classroom teaching, or for any other desired use. In FIGS. 6–8 and 10, the desk 1 is shown opened so that the computer system housed within the desk can be used.

The desk 1 includes a right leg 3 and a left leg 5, both of which have ground engaging feet 7. Pads 8 can be placed on the bottom of the feet 7. A desk top 9 extends across the top of the legs 3 and 5. The desk top is preferably opaque. The desk top includes an openable portion 9*a* and a fixed portion 9*b*. Supports 10 are positioned along the inner surfaces of the legs at the tops of the legs. The supports 10 preferably extend the depth of the legs, from the front of the legs to the back of the legs. The supports 10 have an upper surface which is preferably flush with the top edge of the legs 3 and 5, and upon which the openable portion 9*a* of desk top rests.

Figure 4:
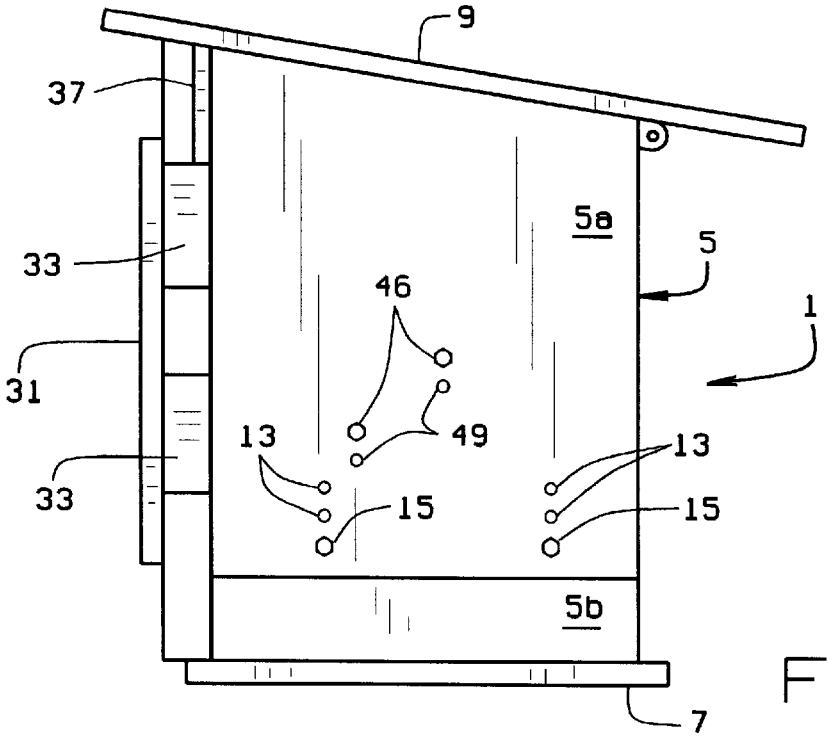
FIG. 4 is a left side elevational view of the computer desk.
Figure 13:
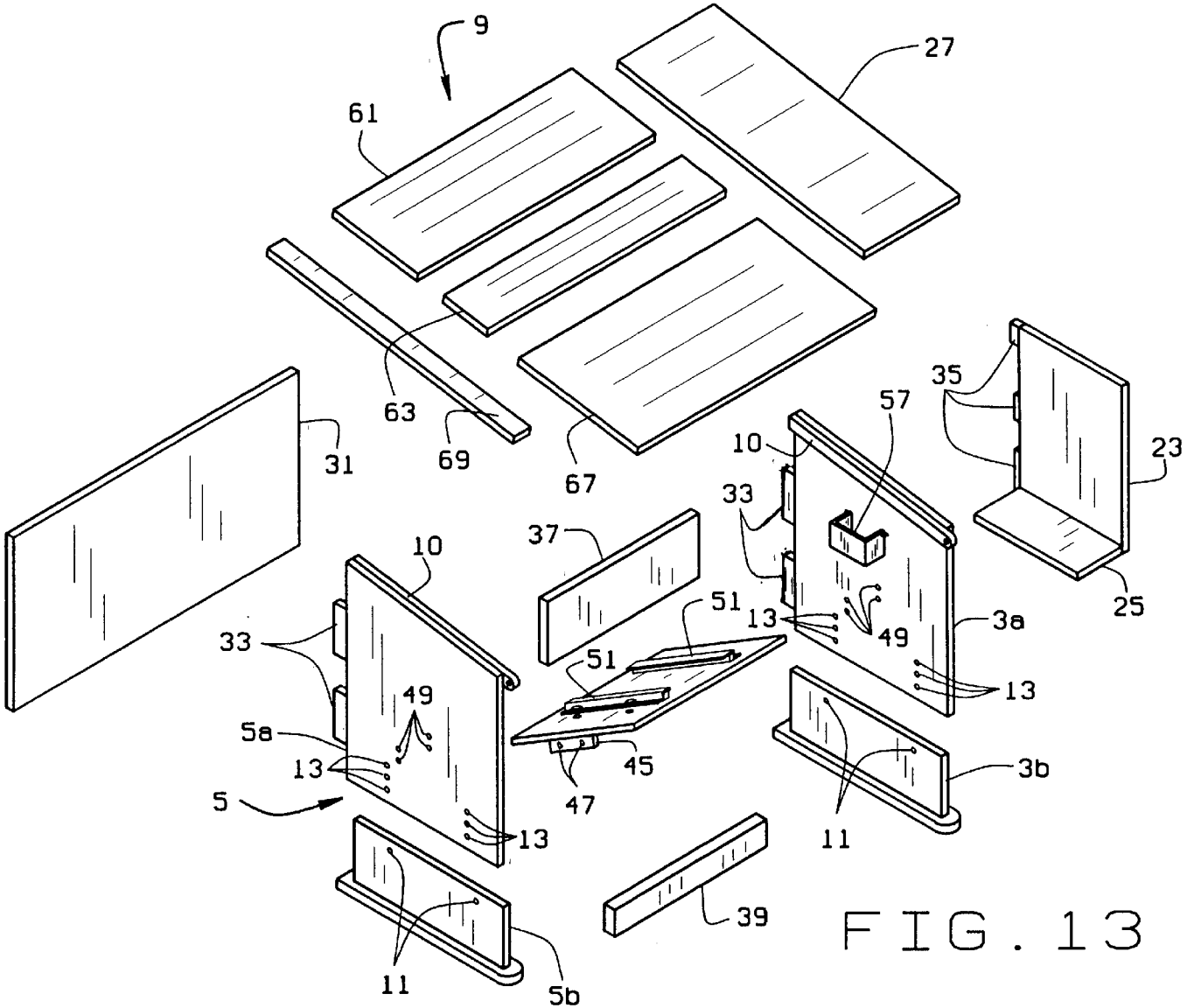
FIG. 13 is an exploded view of the desk.

The legs 3 and 5 are preferably made from two parts, upper parts 3*a* and 5*a*, and lower parts 3*b* and 5*b*. The lower leg parts 3*b* and 5*b* each have a pair of horizontally spaced apart bolt holes 11 (FIG. 13). The upper parts 3*a* and 5*a* each include a plurality of pairs of horizontally spaced apart bolt holes 13. The pairs of bolt holes 13 are vertically spaced apart, as seen in FIG. 4. The spacing between the lower part bolt holes 11 and the upper part bolt holes 13 is the same, so that the bolt holes in the upper and lower leg parts can be aligned. Bolts 15 are passed through the bolt holes to secure the leg parts together. Nuts 17 (preferably wing nuts) are applied to the threaded shafts of the bolts 15 to prevent the bolts 15 from coming out of the bolt holes 11 and 13. The provision of the vertically spaced apart bolt holes 13 in the upper leg parts 3*a* and 5*a* allows for the height of the desk top 9 to be adjusted. Three pairs of bolt holes are shown in the drawings, thus the desk top can be adjusted to three different heights. This enables to the desk to be lowered for use by a child, or raised for use by an adult. Obviously, more or fewer bolt holes can be provided to allow for fewer or more increments in the height of the desk top 9. The use of wing nuts to secure the bolts eliminates the need for tools to adjust the desk top height. The wing nuts can be loosened by hand. Any other conventional means can be used to raise and lower the height of the desktop 9.

Figure 9:
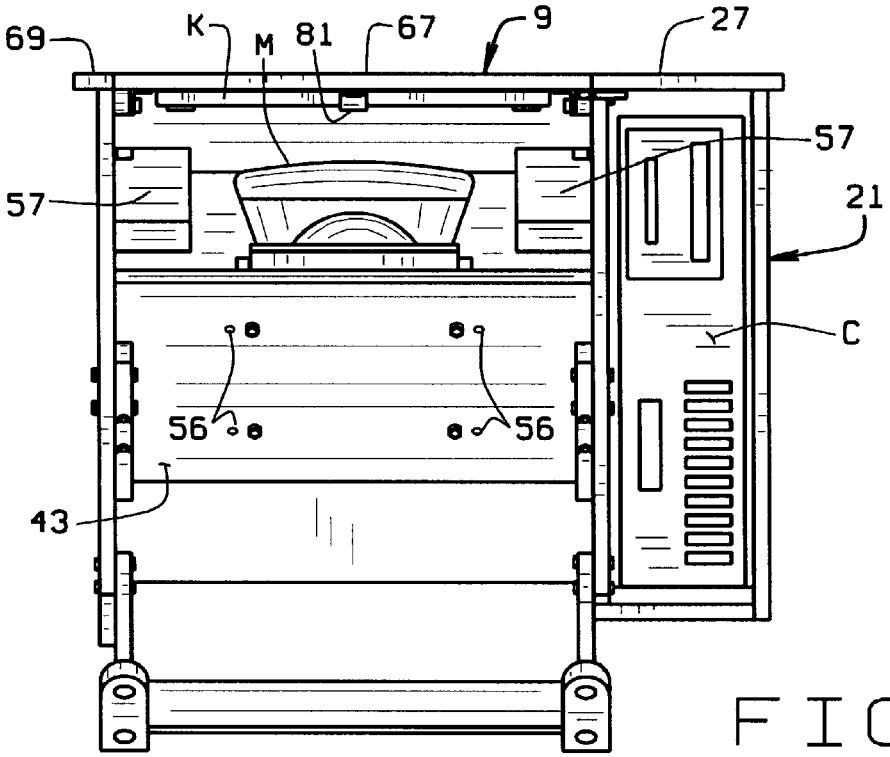
FIG. 9 is a bottom perspective view similar to FIG. 2, but with the computer system placed in the desk.

A computer box 21 is mounted to an outer surface of the right leg 3. The computer box includes an outer side panel 23, a bottom panel 25, and a top panel 27. The panels 25 and 27, in combination with the right leg 3, forms an open front chamber sized to receive the computer C of the computer system (FIG. 9). As seen best in FIGS. 1 and 2, the computer box top panel 27 forms the fixed portion 9*b* of the desk top 9. The computer box is shorter than the leg 3. Preferably, the computer box has a height generally equal to the upper part 3*a* of leg 3. Thus, the lower panel 25 is secured to the leg 3 near its bottom edge, and the upper panel 25 is secured to the leg 3 at its top edge, to be flush with the openable portion 9*a* of the desktop. The opened front of the computer box 21 is spaced rearwardly from the front of the right leg 3, and the back of the computer box 21 is spaced rearwardly from the back of the right leg 3. However, the lower or bottom panel 25 of the computer box 23 is preferably shorter than the side panel 23, and has a back edge which is generally flush with the back edge of the leg 3.

The computer box 21, as shown in the drawings, is sized to receive a so-called tower computer. However, the computer box 21 could be made smaller to receive a so-called mini-tower or even a flat computer. Alternately, a mini-tower or flat computer could be placed in the computer box, and shelves could be formed either above or below the computer to hold manuals, paper, books, etc.

The legs 3 and 5, and the computer box outer panel 23 are preferably configured so that the desk top 9 will have a slight slope, for example, about 8°.

A back panel 31 or modesty panel extends between the left leg 5 and the outer panel 23 of the computer box. The modesty panel 31 is spaced from the back of the legs 3 and 5 by spacers 33 and from the back of the computer box outer panel 23 by spacers 35. Because the back edge of the computer box outer panel 23 extends behind the back edges of the legs 3 and 5, the spacers 33 are longer than the spacers 35 so that the panel 31 will be generally at a right angle to the legs 3 and 5 and to the computer box outer panel 23. The back panel 31 extends the width of the desk, from the left leg to the computer box outer panel. However, it does not extend the full height of the leg 5 or the computer box outer panel 23. An upper back panel 37 extends between the backs of the right and left legs 3 and 5. The back panel 31 is thus longer than the upper back panel 37. The upper back panel 37 is positioned directly below the desktop 9 and above the back panel 31. The back panel 31 has a top edge which is approximately even with the bottom edge of the upper back panel 37. Because the upper panel 37 is secured to the back edges of the legs 3 and 5, the back panel 31 is spaced, at least in part, from the upper back panel 37. A kick panel 39 extends between the lower legs 3*b* and 5*b*, and serves to hold the legs together at their bases.

As can be appreciated, the back panels 31 and 37 form the back to the computer box 21, so that the box is essentially opened only on its front.

Figure 5:
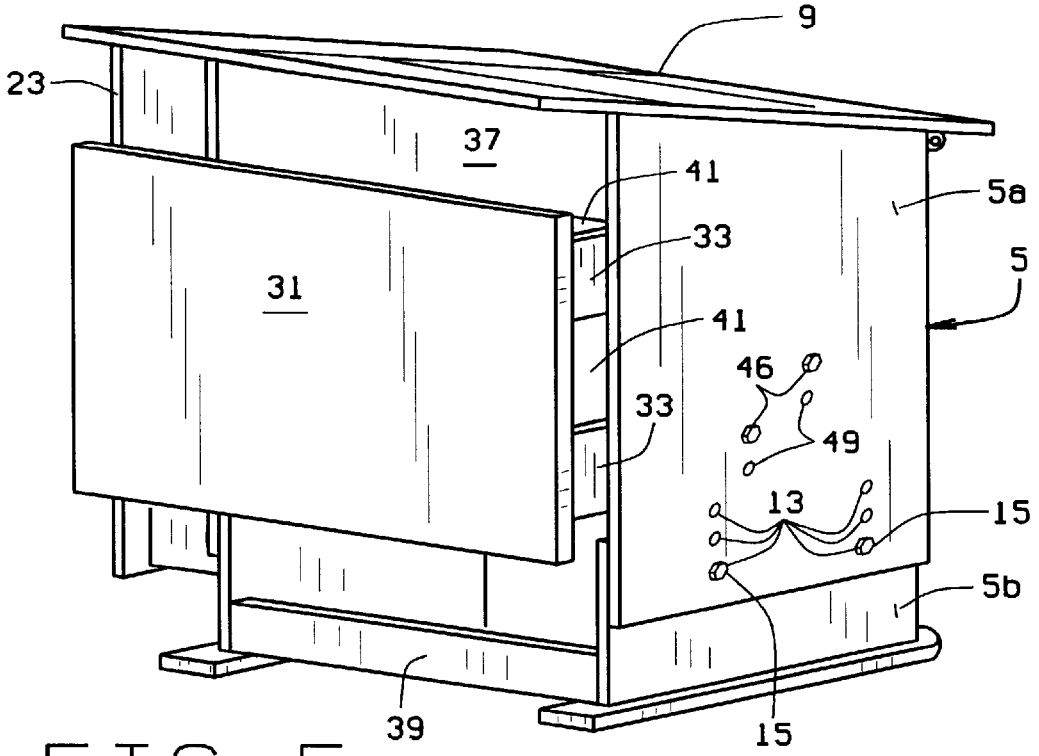
FIG. 5 is a rear perspective view of the computer desk.
Figure 6:
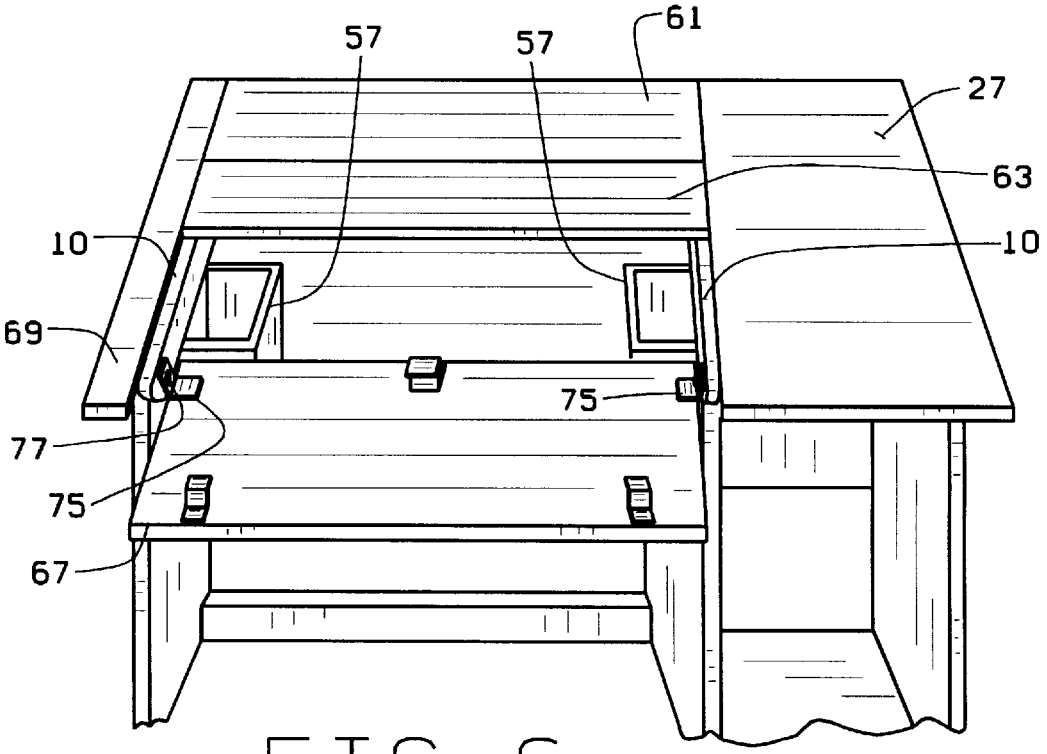
FIG. 6 is a top perspective view of the desk showing the forward, keyboard tray, portion of the desktop opened.
Figure 12:
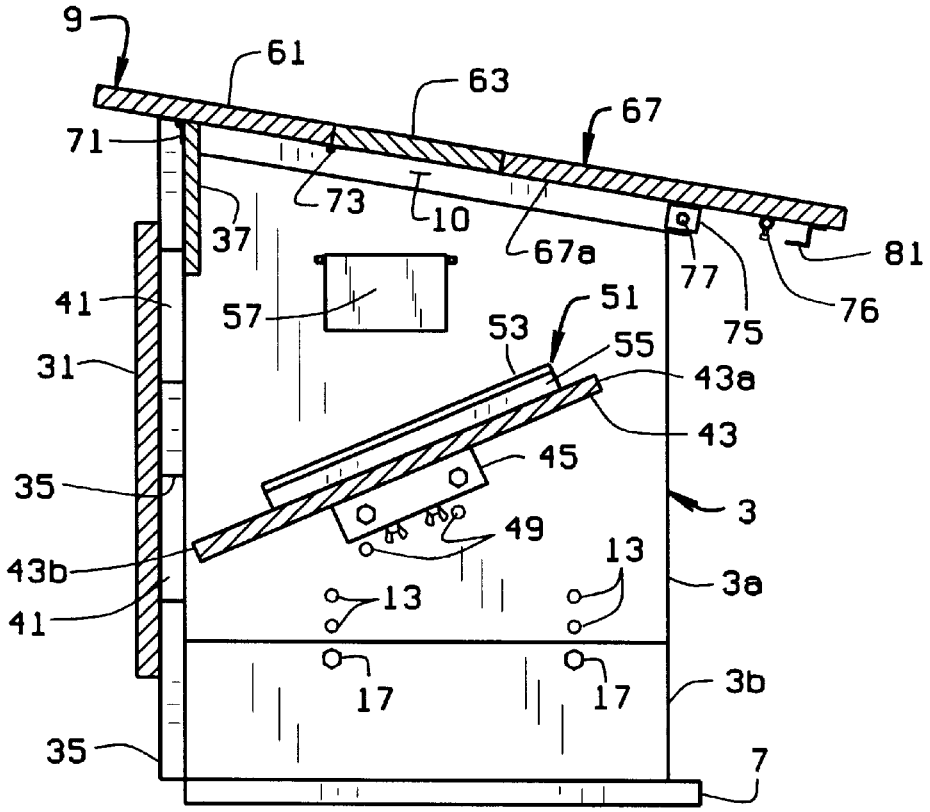
FIG. 12 is a cross-sectional view of the desk taken along line 12—12 of FIG. 1.

As can be seen, especially in FIG. 5, the back panel 31 is spaced from the upper back panel 37 and from the legs by the spacers 33 and 35. This creates air vents 41 all around the back panel 31. The air vents allow for air flow through the desk to help prevent overheating of the computer system contained within the desk. As seen in FIG. 12, the spaces 41 between the back panel 31 and the right leg 3 is sufficiently large to pass computer cables, and associated connectors from the computer to the monitor, the keyboard, and the mouse, all of which placed on the opposite side of the right leg 3 from the computer C. Thus, none of the wiring for the computer (except for a power cord and a network cord if the computer is connected to a network) will be exposed.

Figure 10:
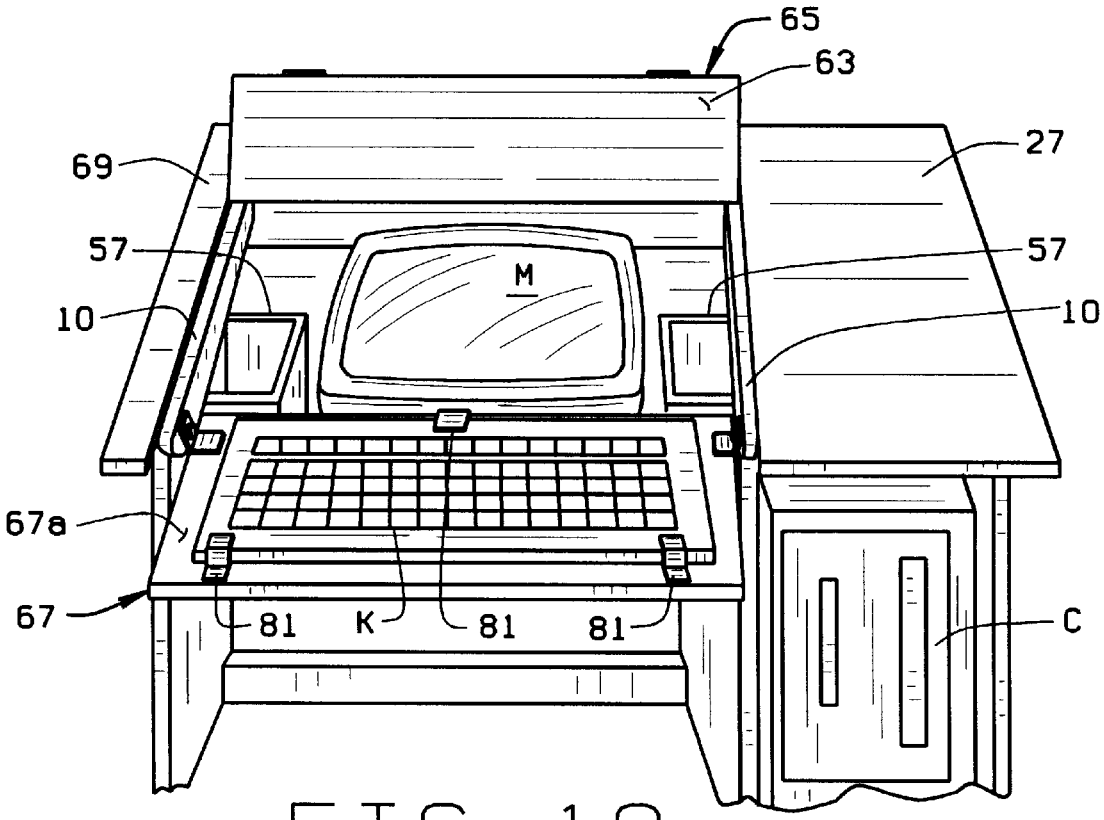
FIG. 10 is a perspective view similar to that of FIG. 8 of the desk opened, showing the keyboard and monitor in their respective positions.
Figure 11:
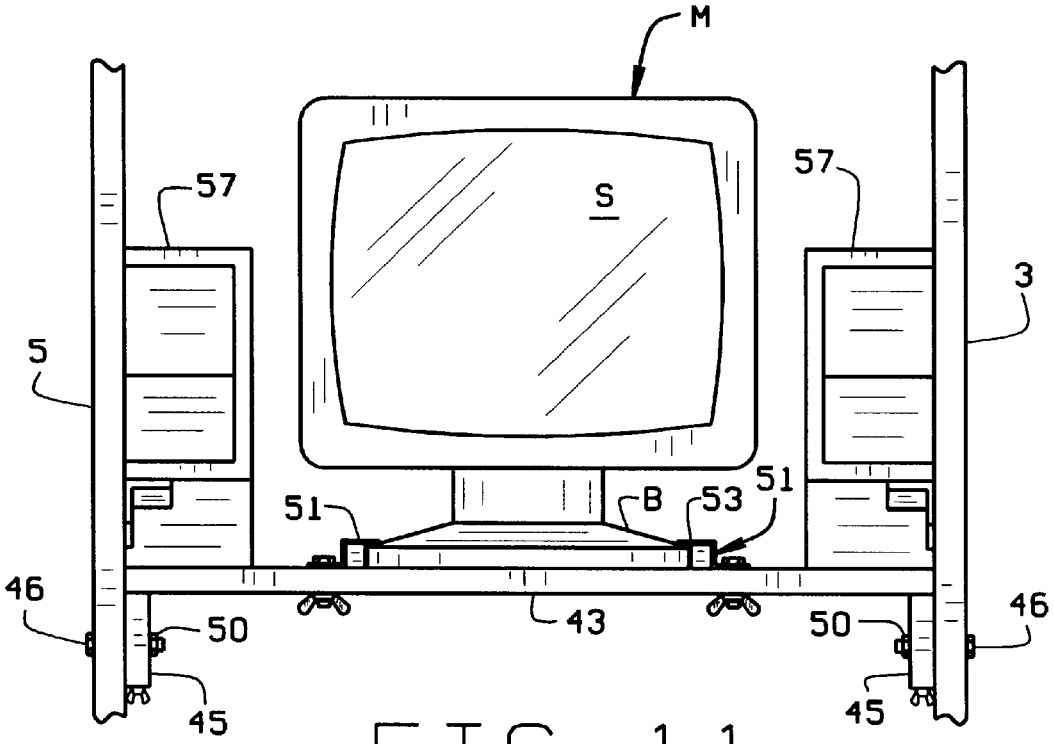
FIG. 11 is an enlarged view showing the mounting of the monitor on a monitor shelf.

The desk top 9, legs 3 and 5, and the back panels 31 and 37 form an open front chamber 42 in which the computer monitor M is positioned. A monitor shelf 43 (FIGS. 2, 11 and 12) is mounted in the chamber 43 beneath the desk top 9 and extends between the legs 3 and 5. Preferably, the monitor shelf slopes rearwardly, such that its forward edge 43*a* is above its back edge 43*b*. The shelf can have a slope of about 30°–70°. This angles the monitor screen S so that it can be easily viewed when the desktop is opened as is shown in FIG. 10. The monitor M is mounted to the shelf 43 using mounting bars 45, best seen in FIGS. 11 and 12, to which the shelf 43 is connected. The mounting bars are fixed to the legs 3 and 5 using bolts 46 connecting to T-nuts which extend through aligned bolt holes 47 and 49 in the mounting bars 45 and the legs 3 and 5, respectively. The shelf 43 is, in turn, fixed to the mounting bars. Preferably, the legs 3 and 5 have two sets of bolt holes 49 (FIG. 4). The monitor shelf can thus be mounted at two different heights. More bolt holes 49, can of course, be provided, if desired. As with the legs, the bolts which hold the mounting bars 45 in place are tightened with wing nuts 50, so that the position of the shelf can be changed without the need for tools, or at most, a pair of pliers. The ability to change the height of the shelf allows for different sized monitors to be used with the desk 1.

Generally, the monitor M includes a screen S mounted on a base B. The monitor shelf 43 includes a pair of spaced apart brackets 51 (FIG. 11) which interact with the monitor base B to hold the monitor in place on the shelf. Preferably, the brackets 51 are S- or L-shaped brackets and have a leg 53 spaced from the shelf which extends generally parallel to the shelf 43. The shelf 43 and the bracket 51 thus define a channel 55 (FIG. 12) sized to slidingly receive the monitor base B. The monitor base is simply slid into the channels 55 and frictionally held in place by the bracket 51. The monitor can be easily removed from the desk, simply by sliding the monitor from the brackets. As seen in FIG. 9, the monitor shelf 43 includes two sets of bolt holes 56 through which bolts extend to secure the brackets 51 to the shelf. This allows for the spacing between the two brackets to be easily changed. The spacing between the brackets 51 corresponds to the average size of monitor bases (i.e., about 9½" to 11").

A pair of storage boxes 57 are mounted to the inner surfaces of the legs 3 and 5 in the chamber 43. The boxes 57 are open topped boxes and are mounted to the legs 3 and 5 above the monitor shelf 43 to be easily accessible to the user, when the desktop 9 is opened. The boxes 57 are sized to hold computer disks, CD's, computer mice, and other small computer accessories or other items.

As seen in FIGS. 1 and 13, the desktop 9 is made of four sections. It includes the computer box top panel 29, two sections 61 and 63 which are hingedly connected together to form a monitor cover 65, a front section 67 which pivots to form a keyboard tray, and a side section 69, which is essentially a trim. The monitor cover 65 and the keyboard tray 67 make up the openable portion 9*a* of the desk top 9. The trim section 69 is fixed to the top of the left leg 5. The computer box top panel 27 is fixed to the top of the computer box outer panel 23 and to the top of the right leg 3.

Figure 7:
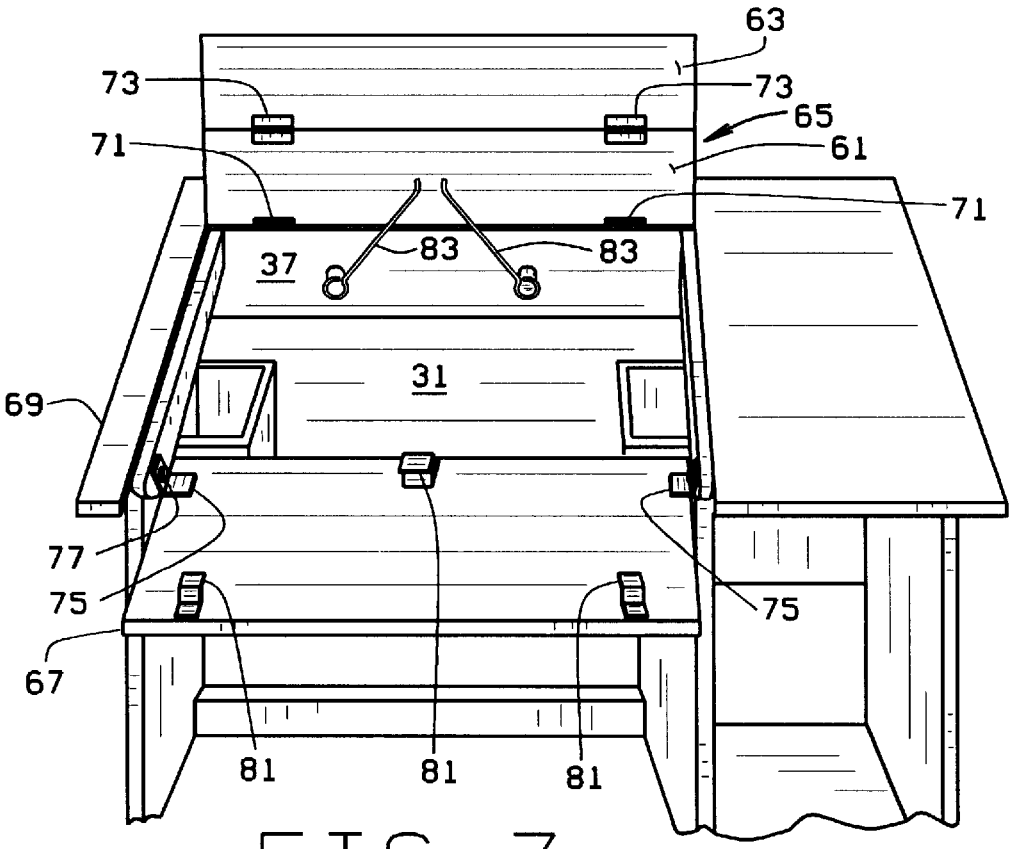
FIG. 7 is a top perspective view of the desk with the rear, monitor cover, portion of the desktop opened.

The desktop back portion 61 is connected to the upper back panel 37 by hinges 71 such that the desktop portion 61 can pivot upwardly away from the legs 3 and 5. Door-type hinges, such as shown in FIG. 7 can be used. Alternately, piano hinges, or any other type of hinged connection can be used in lieu of the hinges 71. Preferably, the hinges 71 are spaced forwardly from the back edge of the desktop portion 61, so that part of the portion 61 will be below the top of the legs when the desktop is opened.

Figure 8:
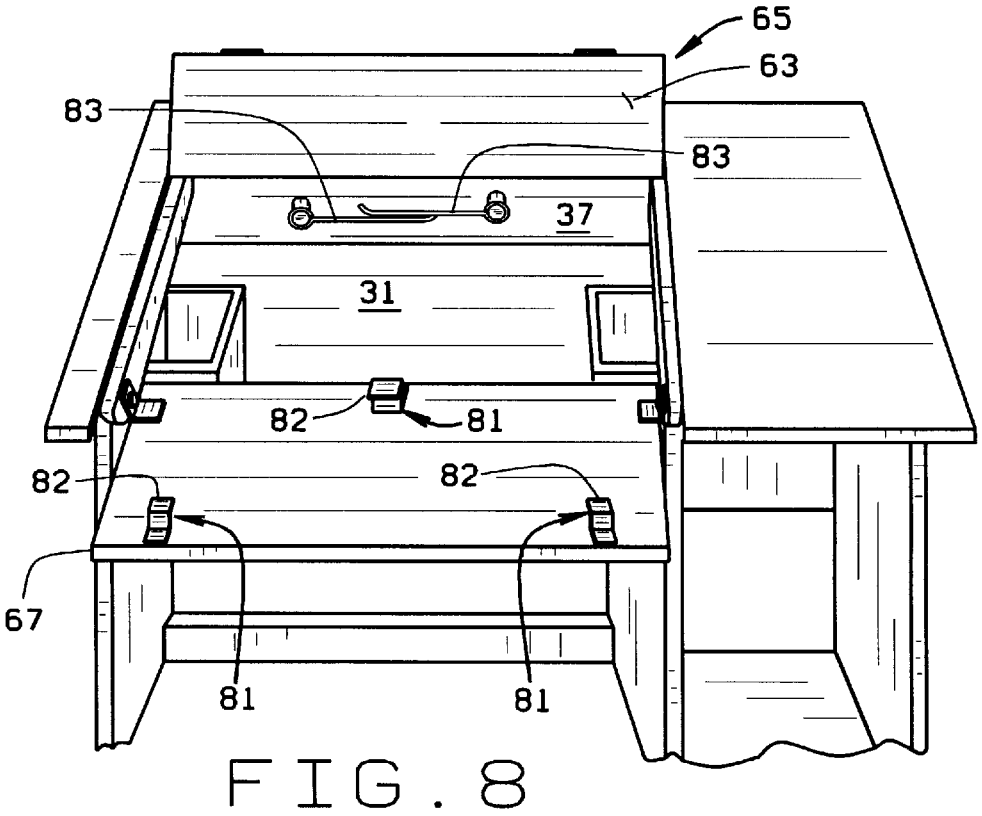
FIG. 8 is a view similar to FIG. 7, but with the monitor cover in a folded position, so that a student can be seen by the classroom teacher.

The desktop portion 63 has a depth generally equal to the distance between the front edge of the desktop portion 61 and the hinge 71. The desktop portions 61 and 63 are connected by hinges 73 so that the middle desktop portion 63 can pivot downwardly relative to the desktop portion 61, as shown in FIGS. 7 and 8. Again, any type of hinged connection can be used to connect the desktop portions 61 and 63.

The front desktop portion 67, as noted, is the keyboard tray. It is pivotably mounted between the desk legs 3 and 5 by L-shaped brackets 75 and bolts 77. (FIG. 12) The brackets 75 are positioned on the underside 67a of the desktop portion 67. As seen in FIG. 12, the bracket 75 is positioned approximately midway between the front and back edges of the desktop portion 67. Thus, when the keyboard tray portion 67 is pivoted from the closed position (FIG. 1) to the opened position (FIG. 8), the user will not have to move back at all, or at most, may only have to move back a slight bit, to use the keyboard. In situations where the amount of forward and rearward movement of the person sitting at the desk is limited, this construction is particularly helpful.

The keyboard tray 67 is held closed by a sliding bolt lock 76. (FIG. 2) The lock 76 includes a sliding bolt 77 which is mounted to the underside of the fixed portion 9*b* of the desktop and a sleeve 78 which is mounted to the keyboard tray. When the bolt 77 is slid into the sleeve 78, the tray cannot be opened. When the tray 67 is unlocked and pivoted to the opened position, the lock sleeve 78 engages the underside of the desktop support bars 10. By altering the position of the lock 76 relative to the front edge of the desktop 9, the position at which the lock sleeve 78 engages the support 10 is altered. This will affect the angle of the keyboard tray 67 when in the opened position. Any other type of locking mechanism can be used to prevent accidental opening of the keyboard tray 67.

The keyboard tray 67 includes three S- or L-shaped brackets 81 (FIG. 8) to hold the keyboard K in place on the underside 67*a* of the tray 67. The brackets 81 all include a top leg 82 which is spaced above and generally parallel to the tray 67. The keyboard K fits between the tray 67 and the bracket legs 82. The brackets thus hold the keyboard K on the keyboard tray when the tray is in its closed position. The keyboard tray 67 is shown with one bracket 81 at the back of the tray and two brackets at the front of the tray (when the tray is in its opened position). The position of the brackets could be reversed. Alternately, the number of brackets could be changed. For example, four brackets could be provided.

To maintain the desktop substantially flat, no handles or hand holds are formed on the outer or upper surface of the desktop 9. To open the desktop to use the computer, the keyboard tray 67 is pivoted to the opened position simply by pressing on the forward edge of the keyboard tray. Once the keyboard tray is opened, as in FIG. 6, then the monitor cover 65 can simply be pivoted upwardly, to be moved from the position shown in FIG. 6 to the position shown in FIG. 7. With the monitor cover 65 in the opened position, a book or other article can be placed on the top edge of the upper back panel 37. A pair of spring wires 83 (FIGS. 7 and 8) can be pivotally mounted to the upper back panel 37. To keep the book in position, the spring wires 83 can be pivoted upwardly, as shown in FIG. 7. The monitor cover, in the fully up position, as shown in FIG. 7, is fairly tall, and would block a teacher's view of a student using the desk. To lower the height of monitor cover 65, the desktop middle portion 63 can be pivoted from the position shown in FIG. 7 to the position shown in FIG. 8. In this position, the spring wires would have to be in a lowered position, as seen in FIG. 8.

Figure 14:
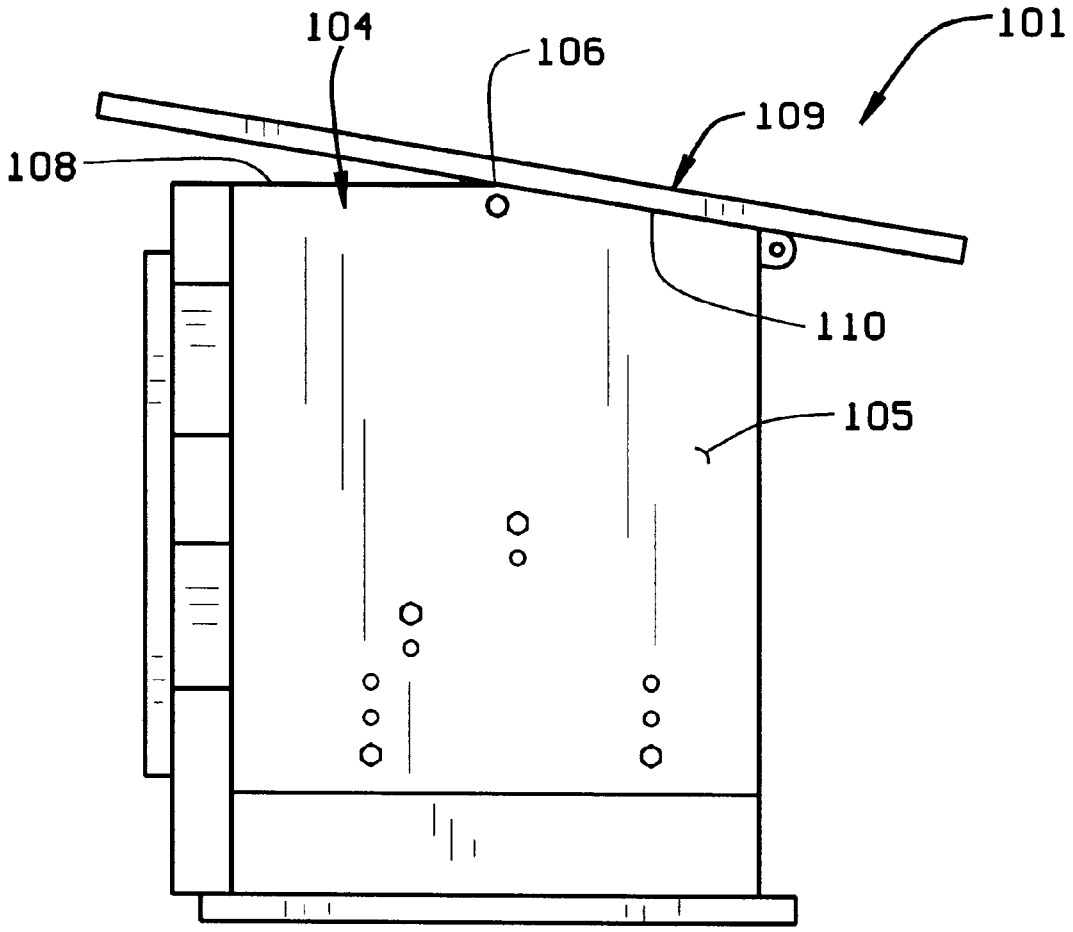
FIG. 14 is a side elevational view of an alternative embodiment of the desk with a tiltable desk top.

An alternate embodiment of the desk is shown in FIG. 14. The desk 101 of FIG. 14 is substantially similar to the desk 1 of FIGS. 1–13. However, the top edges of the legs (only leg 105 is shown) and the outer panel of the computer box all have a top edge 104 having an apex 106, a portion 108 which is generally flat, and a portion 1 10 which slopes forwardly from the apex 106. The desktop 109 is pivotally mounted to the legs, the apex 106 defines the pivot point for the desk top. Thus, the desktop 9 can be pivoted to a desired angle or flat.

As can be appreciated, the computer desk 1 is easy to use, and is convertible between a closed position in which it can be used as a flat desk, and an opened position to expose the computer monitor and keyboard so that the computer system may be used. The computer C is easily accessible to turn the computer system on and off, and to insert disks as may be needed into the removable disk drives of the computer. The keyboard pivots, rather than slides, to expose the keyboard. Thus, the overall front-to-back length of the computer desk does not change when the desk is opened, and the user does not need to move rearwardly to use the keyboard.

In school, and other public, situations, theft is often a consideration. In computer rooms, in which computers sit on table tops, the computers are easily stolen. In the computer desk 1 of the present invention, the brackets 51 and 81 hold the monitor and keyboard in position, making it difficult to remove the components from the desk without removing the brackets. Although not provided, a lock can be provided to lock the desk top closed. Additionally, a lockable door or equivalent can be used to cover all or a portion of the front of the computer box 21 to make it difficult to easily remove the computer C from the computer box 21.

As various changes could be made in the above constructions without departing from the scope of the invention, it is intended that all matter contained in the above description or shown in the accompanying drawings shall be interpreted as illustrative and not in a limiting sense. For example, the legs 3 and 5 can be made from one piece, rather than two. This would eliminate the ability to adjust the height desk top by altering the leg length. The height of the desktop could be made to be alterable in other ways. Although not preferred, the pivotable keyboard tray could be replaced with a sliding keyboard tray. The sliding bolt lock 76 can be replaced simply with an arm which will slide from beneath the desktop fixed portion 9*b* under the keyboard tray portion of the desktop. The arm will interfere with the pivoting of the desk top keyboard tray to maintain the tray closed against accidental opening. These examples are illustrative only.

I claim:

1. A computer desk which houses a computer system, the computer system including a computer, a monitor, and a keyboard; the computer desk comprising:

a first leg, a second leg, and a desk top extending between the first and second legs;

a monitor shelf below the desk top on which the monitor sits;

a computer box sized and shaped to accept the computer; and said desk top including a pivotable portion, said pivotal portion being selectively pivotable between a closed position in which said desk can be used as a writing desk, and an opened position in which the monitor and keyboard are exposed to facilitate use of the computer system; said pivotable desk top portion including a pivotable forward portion which defines a keyboard tray and a pivotable rear portion which covers the monitor.

2. The computer desk of claim 1 wherein said keyboard tray is pivotable about an axis, said axis being approximately midway between the forward and rear edges of the keyboard tray.

3. The computer desk of claim 2 wherein the keyboard tray includes brackets which hold the keyboard to the keyboard tray.

4. The computer desk of claim 2 including a lock which is operable to hold the keyboard tray in its closed position to prevent inadvertent opening of the keyboard tray.

5. The computer desk of claim 1 wherein the rear portion of the pivotable portion of the desk top includes a first portion which is pivotably connected to a back panel of said desk and a second portion which is hingedly connected to the first portion.

6. The computer desk of claim 1 including a back panel which extends at least the distance between the legs of the computer desk; said back panel being spaced from rear edges of said computer desk legs.

7. The computer desk of claim 1 wherein the vertical position of the monitor shelf relative to the legs of the computer desk can be selectively altered.

8. The computer desk of claim 7 including two or more sets of bolt holes in each of said legs; said monitor shelf including a mounting bar on opposite sides of said shelf, said mounting bars including bolt holes alignable with the a selected set of bolt holes of said legs.

9. The computer desk of claim 1 wherein said monitor includes a monitor screen on a monitor base; said monitor shelf including a bracket shaped and sized to slidably receive said monitor base.

10. The computer desk of claim 1 wherein said legs are adjustable to selectively raise or lower the height of the desk top.

11. The computer desk of claim 10 wherein said legs include a lower portion and an upper portion, said upper and lower leg portions including alignable bolt holes; at least one of said upper and lower leg portions including two or more sets of bolt holes.

12. The computer desk of claim 1 including a supply box mounted on an inner surface of at least one of said legs; said supply box being shaped and sized to hold computer disks, CDs, computer mouse, or other computer related supplies.

13. A computer desk which houses a computer system, the computer system including a computer, a monitor, and a keyboard; the computer desk comprising:

a pair of spaced apart legs;

a computer box adjacent an outer surface of one of said legs and sized to accept the computer of said computer system;

a monitor shelf extending between said legs below an upper edge of said legs;

a back panel which closes at least a part of a back of said desk and at least a part of a back of said computer box; at least a part of said back panel being spaced from rear edges of said legs and computer box to define air vents; and a desk top which covers said legs and said computer box; at least a part of said desk top being pivotal; said pivotal portion of said desk top being selectively movable between a closed position in which said desk can be used as a writing desk, and an opened position in which the monitor is exposed to facilitate use of the computer system; said pivotable desk top portion including a pivotable forward portion which defines a keyboard tray.

14. The computer desk of claim 13 wherein the height of the desk top is selectively adjustable.

15. The computer desk of claim 13 wherein the height of the monitor shelf is selectively adjustable.

16. The computer desk of claim 13 wherein the pivotal portion of said desk top is pivotable about an axis generally perpendicular to the legs of the computer desk.

17. A computer desk which houses a computer system, the computer system including a computer, a monitor, and a keyboard; the computer desk comprising a first leg, a second leg, and a desk top extending over the first and second legs; the desk including a keyboard tray on which the keyboard is mounted; the keyboard tray being pivotable about a substantially horizontal axis; the keyboard tray being selectively pivoted between a closed position in which the keyboard is inaccessible and an opened position in which the keyboard is accessible; wherein, the overall front-to-back length of the desk does not substantially change when the keyboard tray is moved between its closed and opened positions; wherein when the keyboard tray is in its closed position, said keyboard is substantially upside-down.

18. The computer desk of claim 17 wherein the axis about which the keyboard tray pivots is generally in the center of the keyboard tray.

* * * * *